US005455098A

United States Patent [19]

Cheng

[11] Patent Number: 5,455,098

[45] Date of Patent: Oct. 3, 1995

[54] DECORATIVE PLEATS AND METHOD OF MANUFACTURE

[76] Inventor: Tai-Ping Cheng, 73 Bluejay, Irvine, Calif. 92714

[21] Appl. No.: 178,747

[22] Filed: Jan. 7, 1994

[51] Int. Cl.[6] ..... B22B 9/00

[52] U.S. Cl. ..... 428/121; 428/3; 428/73; 428/116; 428/124; 428/126; 428/130; 428/137; 428/155; 428/188; 156/193; 156/197; 156/200

[58] Field of Search ..... 428/121, 124, 428/126, 130, 137, 155, 8, 116, 188, 73; 156/193, 197, 200

[56] References Cited

U.S. PATENT DOCUMENTS 4,450,027 5/1984 Colson ..... 156/193

4,603,072 7/1986 Colson ..... 428/116

5,031,299 7/1991 Lovik ..... 29/454

*Primary Examiner*—Patrick J. Ryan

*Assistant Examiner*—Abraham Bahta

*Attorney, Agent, or Firm*—L. Lee Humphries

[57] ABSTRACT

Decorative pleats have two cuts made in each of two or more pleats and the fold of the pleat is reversed between the cuts. When used as a decorative display for a photograph, picture, merchandise or other item, the cuts may be made angularly to hold the item in place. Cuts may be perpendicular to the fold of the pleat, angular to the fold, zigzag, curvilinear or of other shape. The pleats may be a blind, a lantern or of other shape.

20 Claims, 10 Drawing Sheets

FIG. 7B
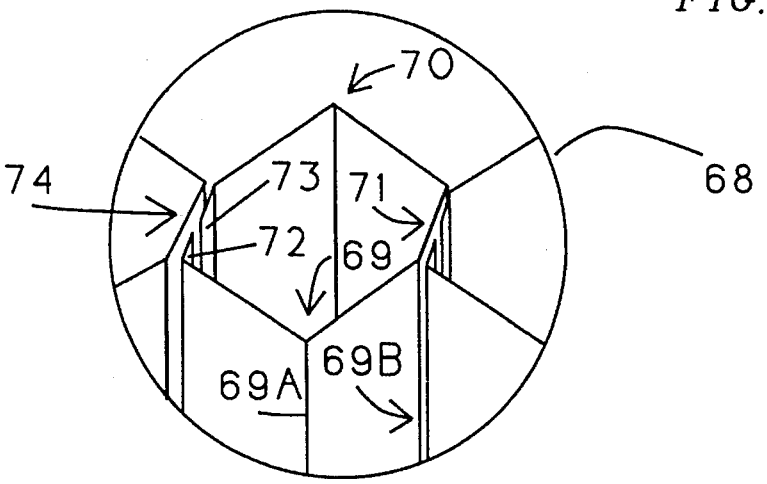
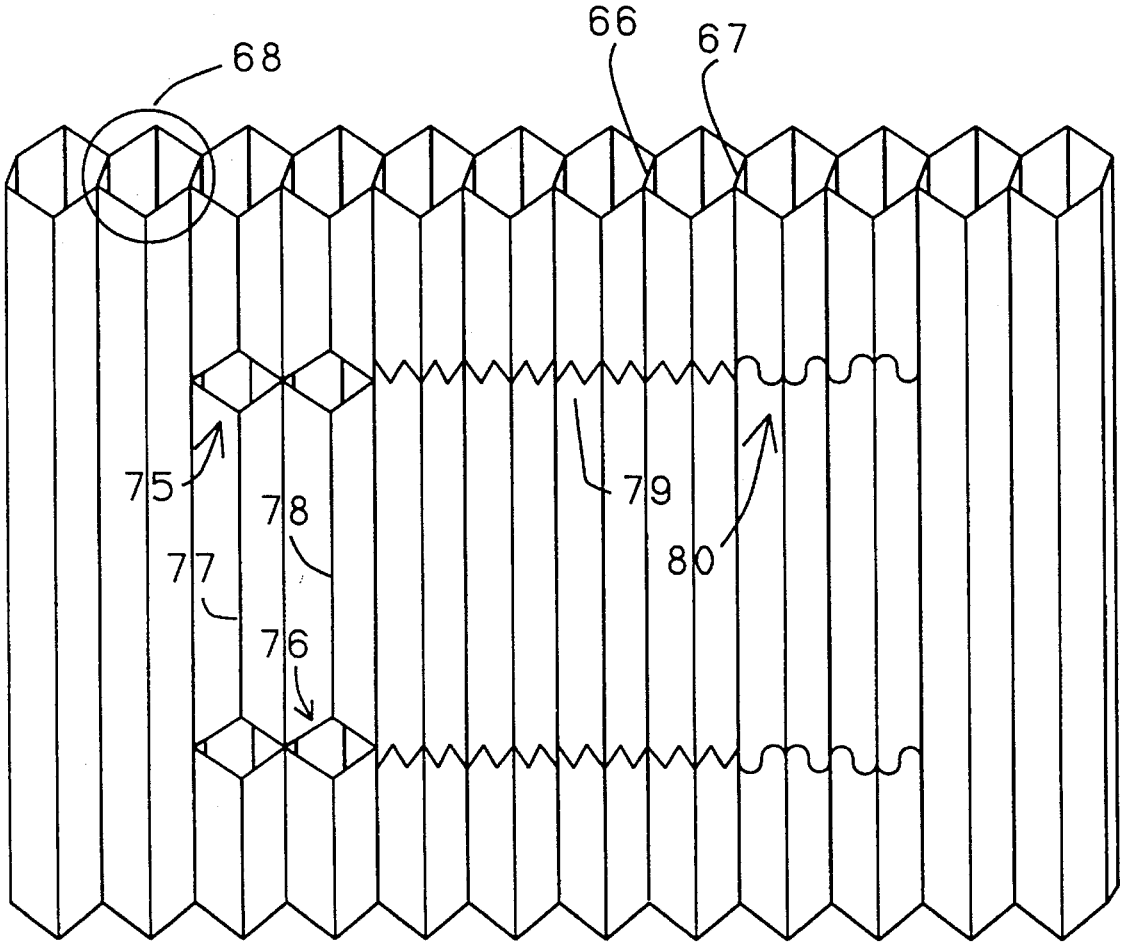
FIG. 7A

DECORATIVE PLEATS AND METHOD OF MANUFACTURE

This invention comprises decorative pleats and the method of manufacture of such decorative pleats. The invention can be used as a decoration for pleated articles and provides a method of manufacture of such decorated, pleated articles. The invention can also be used to provide a decorative, pleated display or the invention can be used as a holder for various items such as, but not limited to, photographs, certificates, paintings, documents, tapestries and quotations. The invention may also be used as a shipping container and then as a display for merchandise, or packaged items.

The invention is useful in decorating a single layer of pleats as well as double layer and triple layers or more.

A double layer of pleats, back to back, is herein termed an "accordion" pleat. Accordion pleats are often used in miniblinds and wall panels. It is also sometimes described as a honeycomb expandable panel as in U.S. Pat. No. 4,603,072, Honeycomb Insulating Material, inventor, Wendell B. Colson. In the accordion pleats, each front and back pleat is usually manufactured out of one piece of material, by folding it longitudinally against itself, as shown in the mentioned patent. That is the preferred form of pleat herein. Alternatively, first and second rows of pleats may be manufactured and placed back to back, to provide an accordion pleat. The front row of pleats may or may not be connected to the back row of pleats, along the line of transition from one pleat in the front row to the adjacent pleat in the front row.

However, accordion pleats customarily have the front and back pleats adhered to each other by a width of material extending between them. Successive pleats are connected to each other by the same width of material, not by a simple fold line. Such width of material extending beyond inner fold lines, is very desirable in the preferred embodiment because it allows cuts from the outer fold line of the pleat to the inner fold line of the pleat, without destroying the interconnecting structure between pleats. Consequently, the pleated article retains its overall structural integrity and shape.

It is preferred, also, in a single layer of pleats that there be a width of material connecting successive pleats to each other.

It is to be appreciated that the pleats may be rounded and not sharply folded. This invention is intended to cover such rounded pleats.

SUMMARY OF INVENTION

This invention comprises decorative pleats in which the fold of one or more segments of two or more pleats are reversed. In the preferred embodiment, the created display is a decorative holder of items to be displayed. A pleated article, having a plurality of pleats, having inner fold lines and outer fold lines, has two cuts in two or more of the pleats, from the outer fold line to approximately the inner fold line. The fold of the segment of each pleat, between the cuts, is reversed by being pushed inwardly. The outer fold line of the segment of the pleat between the cuts becomes reversely folded, similarly to the inner fold line.

It is noted that in the original construction, the inner fold line is customarily the line of joinder between two successive pleats, which are individual segments of material adhered together. That is, the inner fold line is formed along a line where two pieces of material, successive pleats, are adhered together.

This invention also comprises the method of cutting each of two or more pleats at one or more locations and reversing each cut pleat, between the cuts, to fold inwardly rather than outwardly.

The effect is quite pleasing. Mini-blinds may be decorated by such invention. Oriental lanterns and other figures of revolution which are pleated, may be decorated by such invention. The pleats may be in the shape of a fan. The pleats may be gathered and expanded to form serpentine, curvilinear, spiral, helical and various other shapes.

The cuts in the pleats may be perpendicular to the fold of the pleat, or such cuts may be angularly directed away from each other or toward each other. They may also be zigzag, curvilinear or of numerous other shapes.

When the angular cut is used for a display of a photograph, picture, merchandise or other item, the pleated segment whose fold is reversed, contains the item or items to be displayed. If the cuts in a particular pleat are directed away from each other, the pleated portion, which remains unreversed, overlaps the displayed item and holds it in place.

It is, therefore, an object of this invention to provide decorative pleats.

It is a further object of this invention to provide a decorative, pleated, display which is a holder for various items.

Another object of this invention is a decorative, pleated blind.

Still another object of this invention is a container for merchandise in display.

A further object of this invention is to provide a method of manufacturing decorative pleats.

A still further object of this invention is to provide a method of manufacturing a pleated, decorative, display.

Still another object of this invention is to provide a method of manufacture of a pleated, decorative blind.

DESCRIPTION OF THE DRAWINGS

Further objects and features will be apparent from the following description and drawings in which:

FIG. 7A is a front view of a decorative, pleated display having a double row of pleats, back to back, connected by a width of material between them, said width of material also connecting successive fronts pleats to each other and successive back pleats to each other.

FIG. 7B is an expanded circle, taken from FIG. 7A, showing in greater detail the successive connections between the pleats of FIG. 7A.

DESCRIPTION

Figure 1:
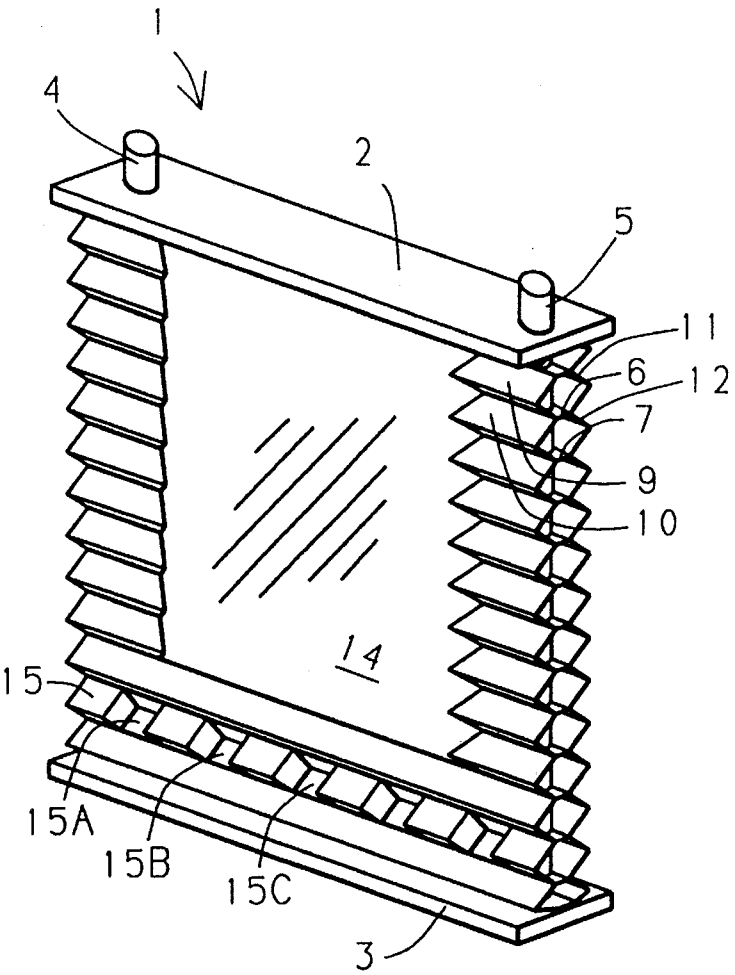
FIG. 1 is a perspective of a decorative, pleated display held by a frame.

FIG. 1 is a perspective of a decorative, pleated display 1 held by a frame comprised of top and bottom rigid elements, or stiffening means, slats 2 and 3, and left and right rigid elements, dowels 4 and 5. The pleats are constructed accordion-like and would be readily expandable and contractible if they were not held by a frame.

Top and bottom slats 2 and 3 are adhered, tacked, stapled or otherwise fixedly attached, respectively, to the top and bottom pleats of the display 1. It is noted that the dowel rods 4 and 5 pass through holes in the widths of material, such as material 6 and 7 between front and back pleats 9 and 10. Such dowel rods 4 and 5 are rigidly connected to top and bottom slats 2 and 3. Such width of material 6 is also the connection between successive pleats 9 and 10 in the front and between successive pleats 11 and 12 in the back.

Pleats 9 an 10 and several successive pleats are cut on the left side and cut on the right side and the fold of the segment of the panel between the cuts is reversed, that is, folded inwardly. Several of such inwardly folded segments provide a display area in which is inserted a displayed article 14, which may be a photograph, a portrait, a painting, a tapestry, an article of merchandise or other item. It is noted that when the invention is used to hold an article of merchandise, the article is held in place, with pleats extending forward of and behind the article of merchandise, to cushion it.

The displayed article 14 is centrally located in FIG. 1. The base, or underside, of the display area is formed by the inner fold lines of the pleats. The display area for the displayed article 14 need not be centrally located but may be placed wherever desired. If the cuts from the outer fold line toward the inner fold line are cut in an angular direction, on each side of the display 1, each cut pleat extends over the displayed item and holds it in place.

It is noted that a decorative, line may be created at the bottom of the display by a number of dual cuts in pleat 15, which allow reversals of outer fold lines, at reversals 15A, 15B and 15C, forming a line of decoration from and along pleat 15.

Pleated material is readily available and is commonly used in mini-blinds. Various materials are used in making the pleated blind. Ordinarily, the material is a plastic material which may be readily pressed, extruded or heat-formed into the pleated shape which is retained by the material. Numerous materials are suitable for use in the manufacture of pleated structures. Among the most favorable are thin, polyester films. Mylar is a suitable film. Synthetic fabrics may also be used. Fabrics, such as but not limited to, cotton, linen, and rayon may be used provided they are of sufficient stiffness. Plastic impregnation of such natural fabrics is often used to render such fabrics more formable. The fabric, when impregnated holds a crease which has been "set" and is otherwise wrinkle-free or crease-proof. Various synthetic resins, such as alkyd, urea-formaldehyde and vinyl resins are examples of commonly used impregnating agents for fabrics. Cellulose (wood flour) may also be used as an impregnating agent.

A machine for manufacturing pleats, without warps and wrinkles, by adhering successive flat, folded, tubular layers together is described in U.S. Pat. No. 4,450,027, Method and Apparatus for Fabricating Honeycomb Insulating Material, inventor, Wendell B. Colson. It is to be appreciated that other means and methods may be used to manufacture the pleated structure.

In some cases, the mini-blind has an insulative quality by having a metallic coating, of silver or other metal, on one or more of the sides and the inside of the pleated material.

Figure 2:
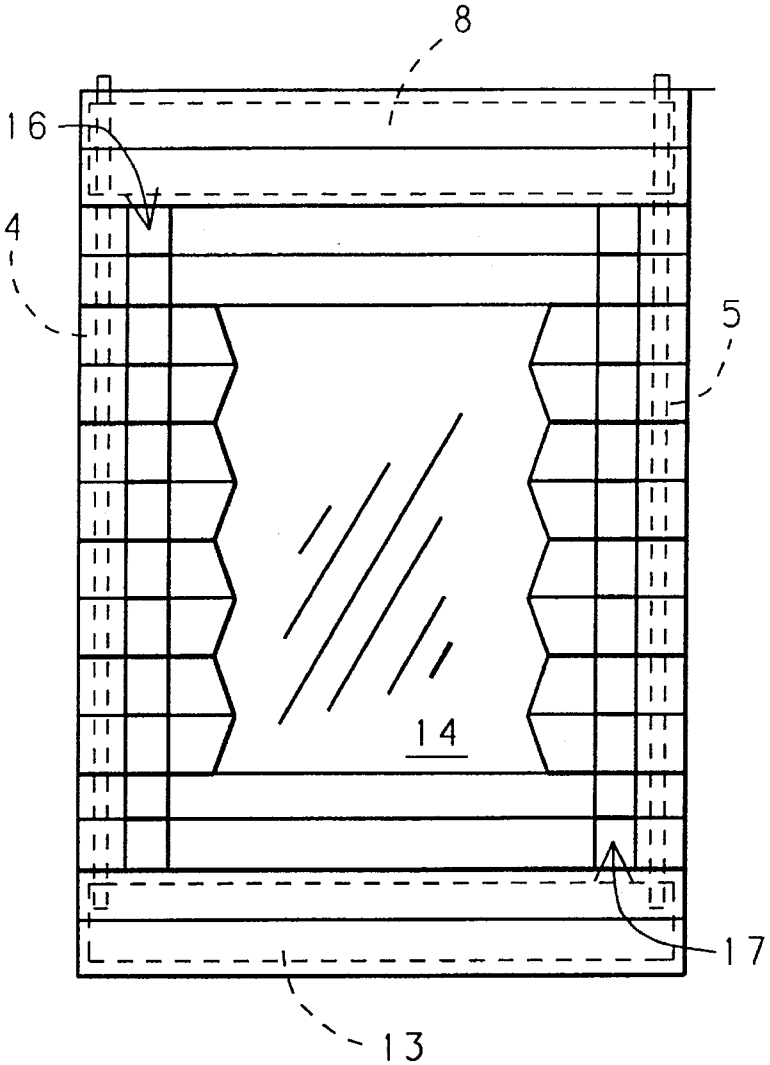
FIG. 2 is a front view of a decorative, pleated display having a hidden frame.

FIG. 2 is a front view of a decorative, pleated display having a hidden frame or stiffening means. The top and bottom pleats of the display have stiffeners 8 and 13 disposed within them, shown by hidden lines. Dowels 4 and 5 are vertically disposed at or near the ends of the display, passing through the pleats to the top and bottom stiffeners 8 and 13, which may themselves be dowels, slats or other stiffening means. Means may be provided at the back of the display, or on the bottom, for holding it upright.

In FIG. 2 there are two vertical decorative strips 16 and 17 which are reversed at intervals in the same way as was pleat 15 in FIG. 1, except in this instance the decorative strips run vertically crosswise of several pleats.

Figure 3:
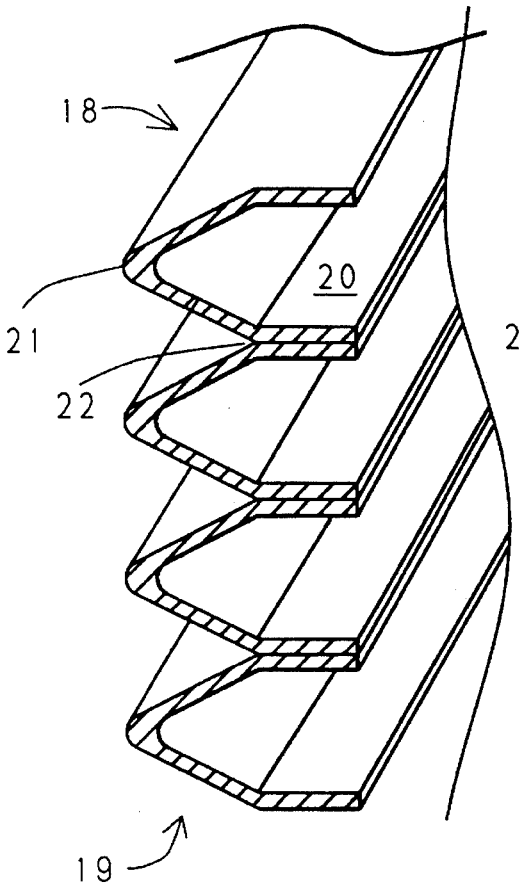
FIG. 3 is a cross-section of a perspective, partial view of a single row of pleats, illustrating the width of material between pleats.

FIG. 3 is a cross-section of a perspective, partial view of a single row of pleats, such as pleats 18 and 19. It is noted that there is a width of material 20 connecting successive pleats 18 and 19 to each other. Thus, the pleats 18 and 19 may be cut from the outer fold line 21 to the inner fold line 22, without destroying or breaking down the overall structure of the pleats. Such structure having a width of material is the preferred embodiment of pleated structure for that reason. If there is no width of material 20 connecting successive pleats, that is, if the connection between successive pleats is simply a fold line, the cut must stop short of the inner fold line. If there is no width of material and if the cut extends through the inner fold line, the pleated material loses its structural integrity and does not hold its overall shape.

Figure 4:
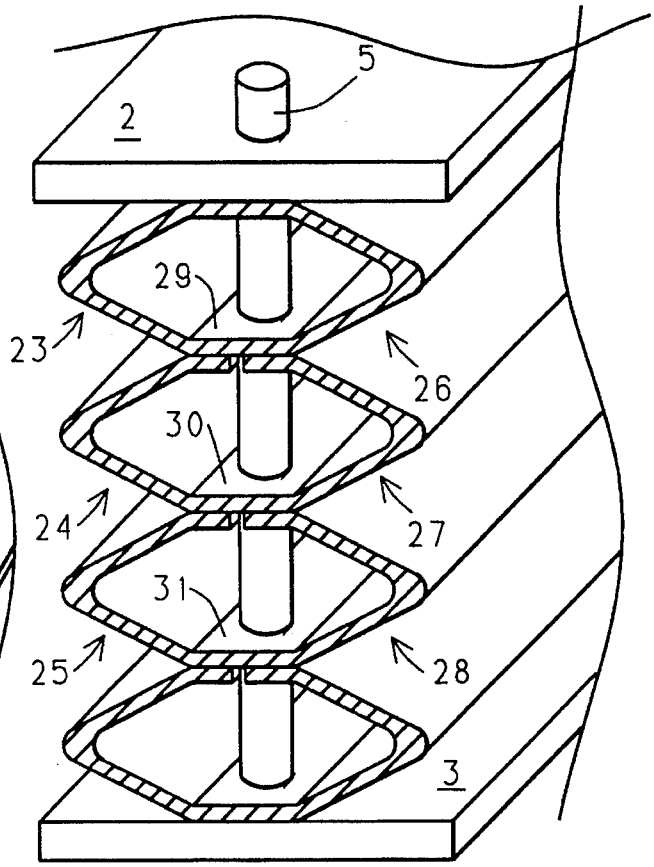
FIG. 4 is a cross-section of a perspective, partial view of decorative, accordion pleats comprised of both front and back pleats connected by a width of material between them, said width of material also connecting successive front pleats to each other and successive back pleats to each other. Also shown is a dowel rod passing through successive pleats.

FIG. 4 is a cross-section of a perspective, partial view of decorative, accordion pleats comprised of front pleats 23, 24 and 25, and back pleats 26, 27 and 28. The front pleats 23, 24 and 25 are connected to the back pleats 26, 27 and 28, respectively by widths of material 29, 30 and 31. Each width of material, such as width of material 24, also connects front pleats, such as front pleat 23 to the successive front pleats, such as front pleat 24, forming inner fold lines, such as inner fold line 32 between them. Thus, the widths of material 29, 30 and 31 connect the front pleats to the back pleats and, also connects successive pleats in the front and connects successive pleats in the back.

Figure 5:
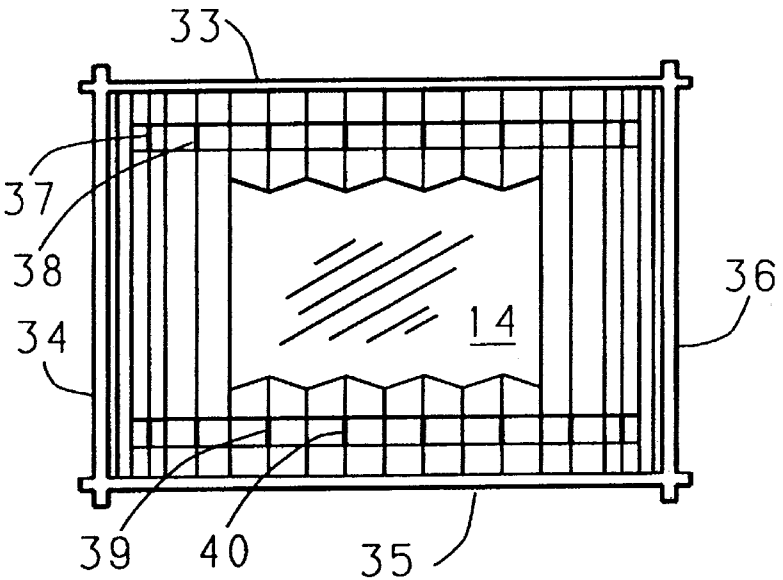
FIG. 5 is a front view of another decorative, pleated display, held by a frame.

FIG. 5 is a front view of another decorative, pleated display 1, held by a frame comprised of four interconnected slats. As in FIG. 1, a central display area holds a displayed article 14. The display area is constructed by reversal of the fold lines of the pleats. Also a series of cuts above and below the display area, allows reversal of the pleats between cuts, such as at reversals 37, 38, 39 and 40, to form aesthetic, interesting, horizontal decorative lines.

Figure 6:
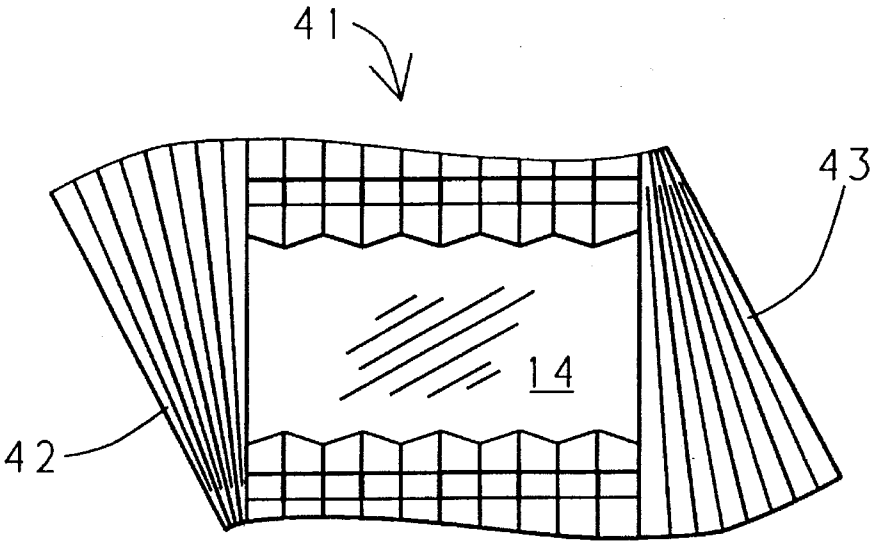
FIG. 6 is a front view of a serpentine, decorative, pleated display.

FIG. 6 is a front view of a serpentine, decorative, pleated display 41. Stiffeners, such as dowel rods, which are invisible, are inserted in the left and right side pleats 42 and 43 and additional dowel rods may be disposed near the upper and lower boundaries of the display, extending crosswise through successive pleats from one side of the display to the other. Thus, a frame may be provided for the serpentine display 41. Alternatively, other means may be used to retain the display 41 in serpentine shape. For example, a backing may be adhered or otherwise attached to the pleats to hold them in serpentine shape. A central display area for displayed article 14 is provided as previously described.

It is to be appreciated that other shapes of pleats may be constructed, such as, but not limited to, a figure of revolution, helical, spiral and curvilinear shapes.

Figure 7:
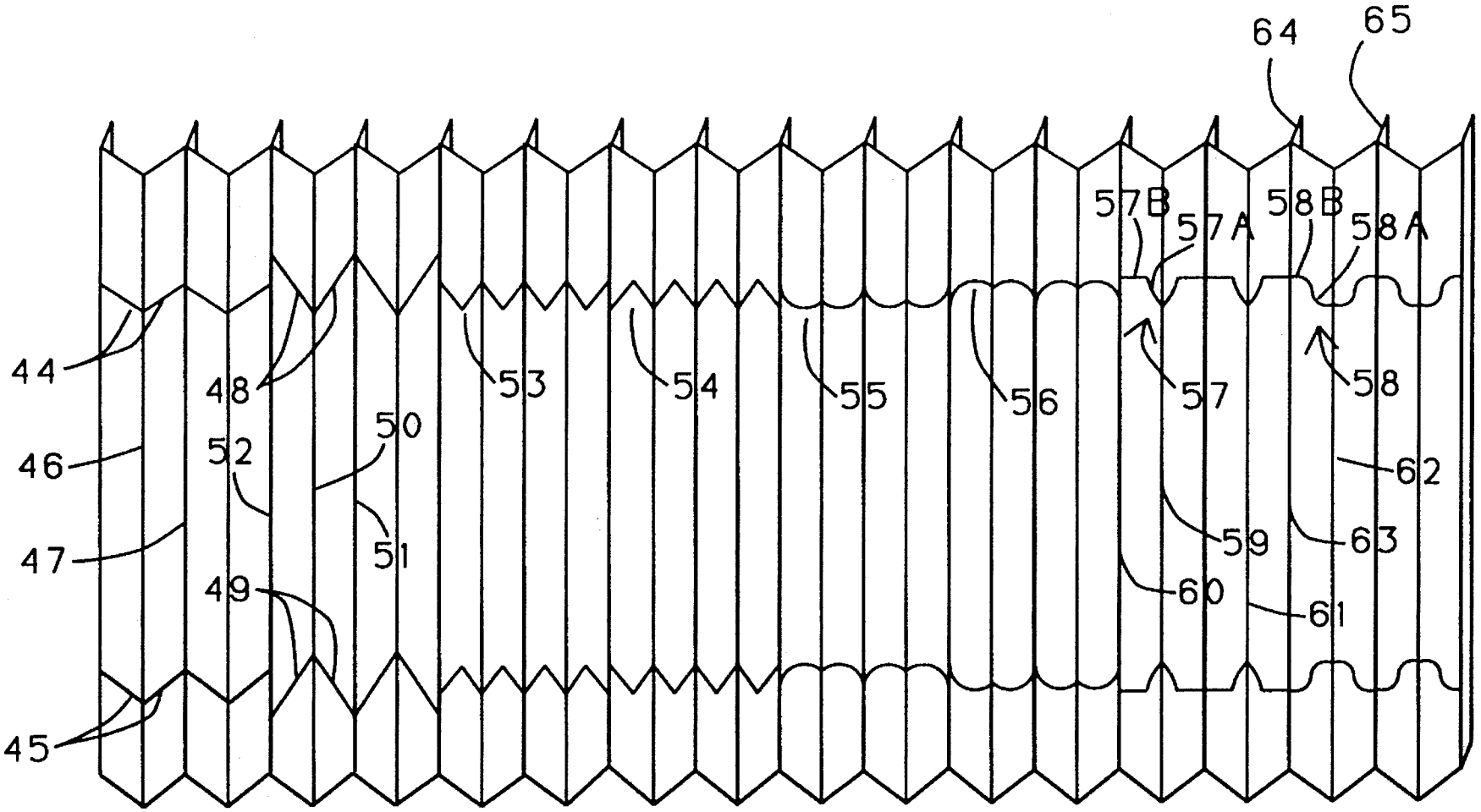
FIG. 7 is front view of a decorative, pleated display having a single row of pleats, illustrating a number of possible cuts.

FIG. 7 is front view of a decorative, pleated display having a single row of pleats. Numerous possible cuts, from outer fold lines to the inner fold lines are shown. The cuts may be perpendicular to the fold line or may be angular as shown by cuts 44 and 45 being perpendicular to the outer fold line 46 and inner fold line 47.

Cuts may also be angular to the fold lines, as shown by cuts 48 and 49 which extend angularly from outer fold line 50 to inner fold lines 51 and 52.

Zigzag cuts are illustrated at zigzag cuts 53 and 54. Curvilinear examples of cuts are illustrated at curvilinear cuts 55 and 56.

Compound cuts, wherein each cut is in at least two directions, are illustrated by cuts 57 and 58. Cut 57 has two parts, part 57A, which is angular to outer fold line 59, and part 57B, which is approximately perpendicular to outer fold line 59 and inner fold lines 60 and 61. Cut 58 likewise has two parts, one of which, part 58A, is curvilinear and part 58B, which is approximately perpendicular to outer fold line 62 and inner fold line 63. By reason of parts 57B and 58B, cuts 57 and 58 are particularly adapted to hold a cubical object, that is, one having depth as well as height and width, for display. The depth of the cubical object is nicely accommodated by such compound cuts.

Widths of material, such as widths of material 64 and 65, which connect successive pleats together, may be seen to maintain the structural integrity of the pleats even after the pleats are cut from the outer fold lines to the inner fold lines.

FIG. 7A is a front view of a decorative, pleated display having a double row of pleats, front and back, which are connected back to back. Widths of material, such as widths of material 66 and 67 connect the front pleats to the back pleats. Such widths of material also connect successive front pleats to each other and successive back pleats to each other.

Greater detail of one exemplary pleated structure is shown in the expanded circle 68, FIG. 7B. Pleat 69 has outer fold line 69A. Pleat 69 is connected to its adjacent pleat by an inner fold line 69B. Such inner fold line 69B lies along or near the connection between adjacent pleats. Such inner fold line 69B is comprised of fold lines of adjacent pleats. In the embodiment shown, the front pleat 69 and the back pleat 70 are formed of the same segment of folded material. A width of material 71 connects the front and back pleats. Ends 72 and 73, of pleats 69 and 70, are adhered to width of material 74 of the adjacent pleats.

Additional possible cut shapes are shown in FIG. 7A. Diamond cuts, such as diamond cuts 75 and 76, provide a different aesthetic design and allow the inside of the back pleats to be visible. Such diamond cuts are made by cutting out a section of one or more pleats and removing the cut out material. The fold lines 77 and 78 are reversed between the diamond cuts, Zigzag cut 79 illustrates a three-element zigzag. Curvilinear cut 80 illustrates a more ornate cut.

Figure 8:
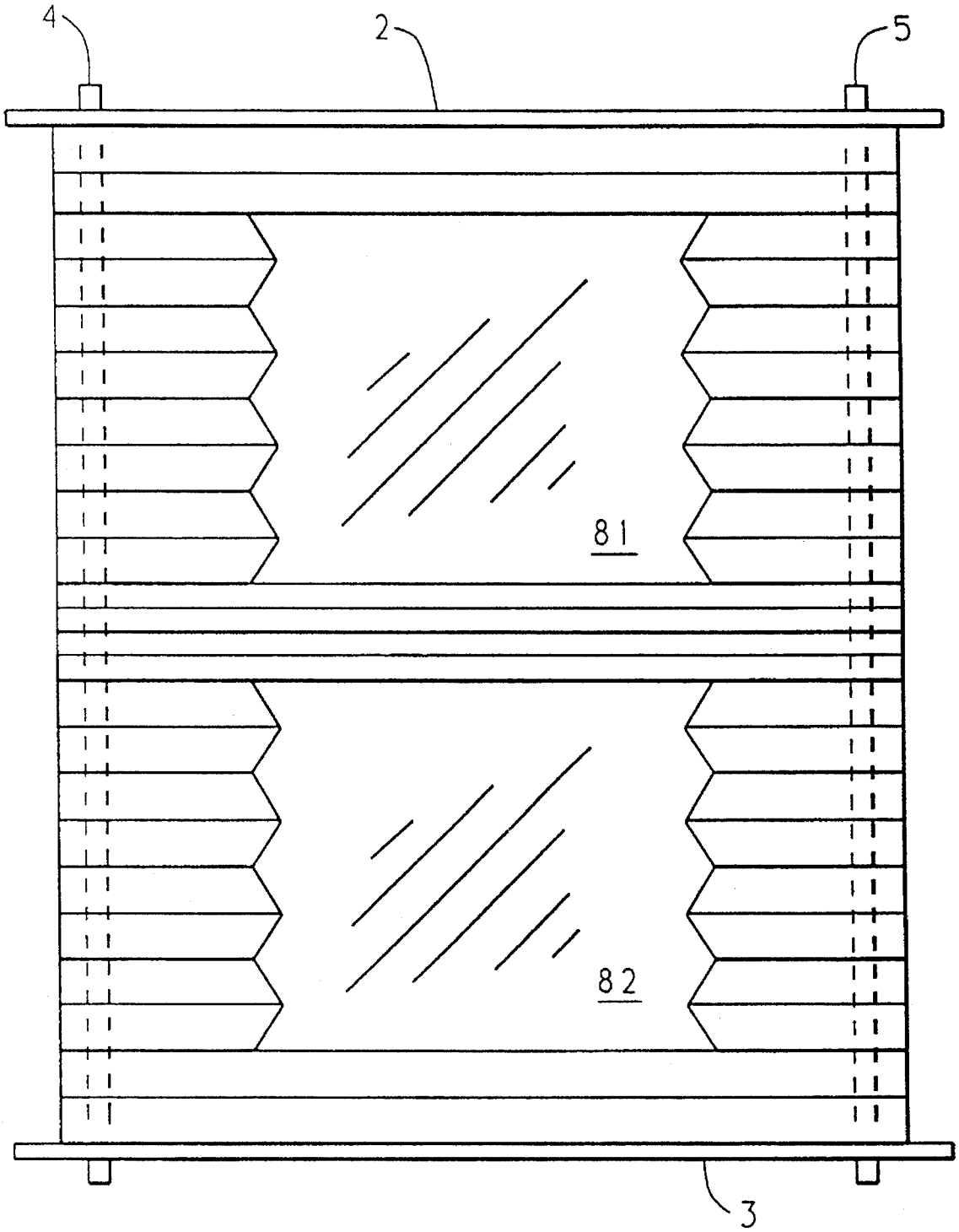
FIG. 8 is a front view of a decorative, pleated display having two areas of display.

FIG. 8 is a front view of a decorative, pleated display having two areas of display in which are located displayed articles 81 and 82. The display is framed, that is, held in rigid position by slats 2 and 3 and dowels 4 and 5. As in FIG. 1, slats 2 and 3 are adhered, or otherwise fixedly attached, respectively, to the top and bottom pleats of the display.

Figure 9:
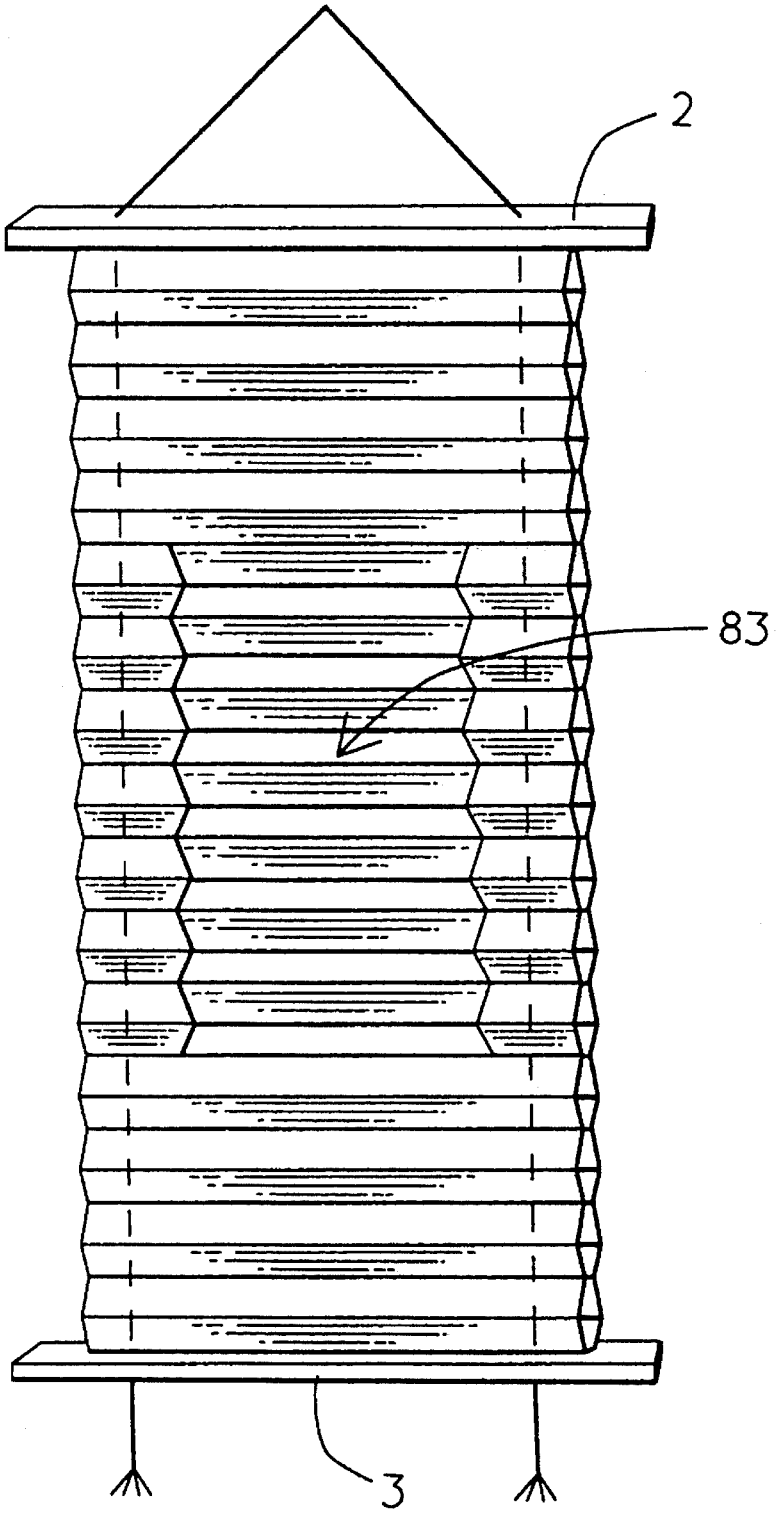
FIG. 9 is a front view of a wall hanging or a blind having pleats reversed in a large central area.

FIG. 9 is a front view of a wall hanging or a blind having pleats reversed in a large central area. A central area 83 of the wall hanging is cut as taught herein and reversed, giving a pleasing, artistic effect. The wall hanging is bounded at the top by slat 2 and at the bottom by slat 3. A string, wire or other means may be used to suspend the wall hanging.

Figure 10:
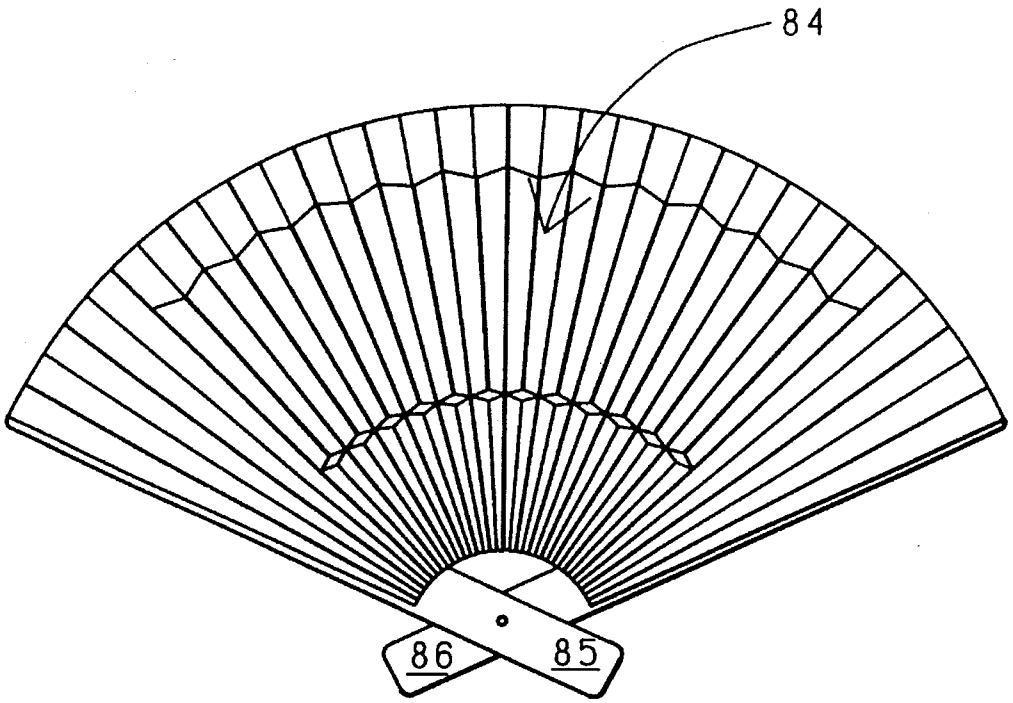
FIG. 10 is a front view of a fan having decorative pleats.

FIG. 10 is a front view of a fan having decorative pleats. A central area 84 of the fan is encompassed by cuts as taught herein. The cuts are made in fan shape and the folds of the pleats, between the cuts, are reversed, giving a pleasing, artistic effect. Slats 85 and 86 are attached to the outer extremities of the fan and give it strength and support. The fan may or may not be allowed to be opened and closed by having stiffening means adhered or otherwise fixedly attached to the rear of the fan or by having stiffening means, such as, but not limited to, a heavy wire threaded through the fan, through, at or near the material widths, discussed previously.

Figure 11:
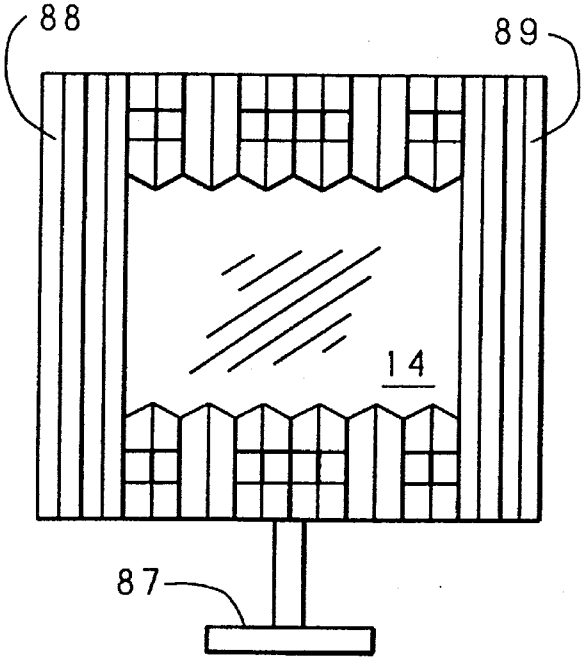
FIG. 11 is a front view of a decorative, pleated display having a stand and concealed frame.

FIG. 11 is a front view of a decorative, pleated display having a stand 87 and a concealed frame. Dowels may be inserted in the vertical end pleats 88 and 89. Hidden dowels may also be inserted horizontally at the top and bottom of the display. As in FIG. 5, the entire display may be held in shape by such a frame.

It is to be appreciated that a frame for such a display may also be provided by a backing, constructed of plywood, stiff cardboard, or other stiff material, attached to the pleats at the back of the display.

Figure 12:
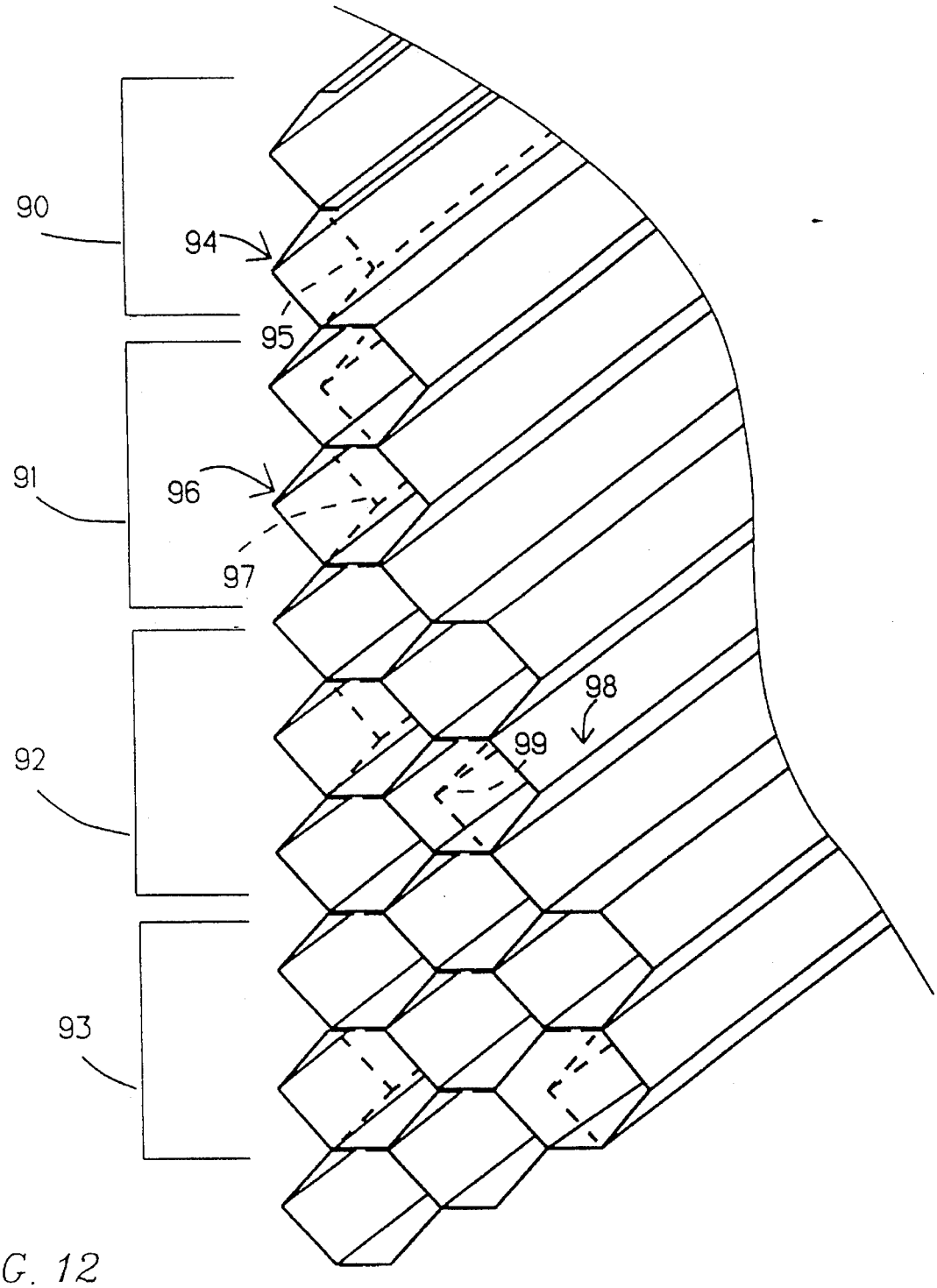
FIG. 12 is a perspective, partial view of four examples of a decorative pleated display, a single row of pleats, a double row of pleats which are back to back, two double rows of pleats and three double rows of pleats.

FIG. 12 is a perspective, partial view of four examples of a decorative pleated display, a single row of pleats 90, accordion pleats, or a double row of pleats, 91, two double rows of pleats 92 and three double rows of pleats 93.

In the single row of pleats 90, it may be seen how the fold off segments of pleat 94 may be reversed, as shown by dotted lines 95. Likewise, in the double row of pleats, the fold of a segment of pleat 96 may be reversed, as shown by dotted lines 97. In the two double rows of pleats 92, not only may the fold of segments of the pleats in front be reversed, but the fold of segments of the back pleats, such as pleat 98, may be reversed, as shown by dotted lines 99. Three double rows of pleats 93 may also have segments that are cut and the fold reversed in the front row of pleats and in the back row of pleats.

Figure 13:
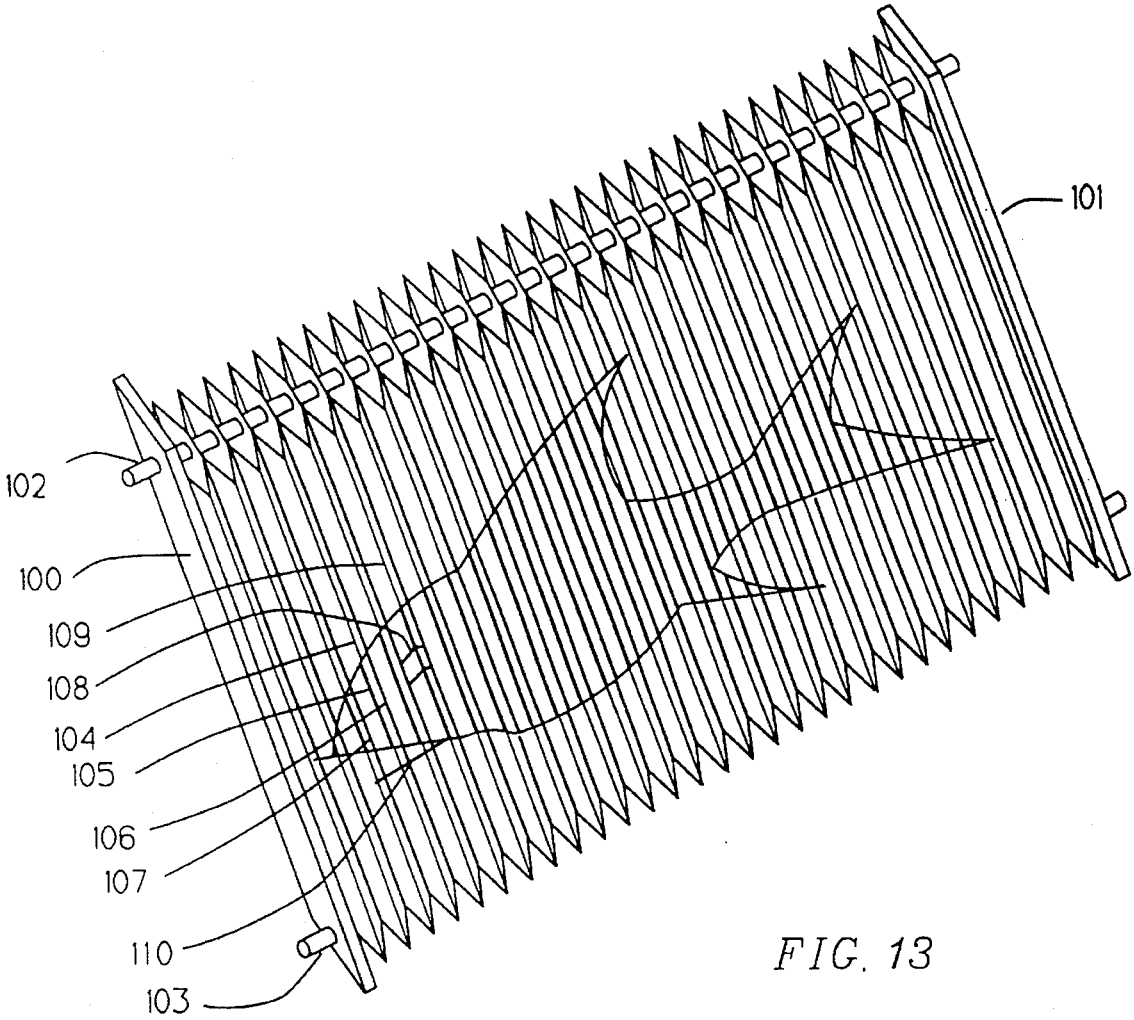
FIG. 13 is a front view of a decorative, pleated display in which the reversed folds are cut to form an illustration, that of a fish.

FIG. 13 is a front view of a decorative, pleated display in which the segments having reversed folds, form an illustration as distinguished from a geometric pattern. In FIG. 13, the illustration is a fish. Slats 100 and 101 and dowels 102 and 103 form a frame for the display. In this embodiment, the slats 100 and 101 are adhered to the end pleats. The dowels 102 and 103 run from slat 101 to 102, through holes in the successive pleats. The picture is most effective if the cuts are perpendicular to the front and back fold lines, however, angular, zigzag and curvilinear cuts as taught herein, may also be used for various illustrative effects.

In explanation, it may be noted that outer fold line 104, when reversed becomes an inner fold line 105, similar to the fold of the pleats on the back side of the display. Inner fold lines 106 and 107 then become more visible and the illustration is generated by the reversed folds of segments of the pleats and the contrast between the reversed folds and unreversed folds. The eye 108 of the fish is a portion of a pleat in which the outer fold line 109 is not reversed. Line 110, forming part of the fish's mouth is a simple cut, without any reversal of fold. 0f course, the mouth may be generated also by cuts and reversal of fold, as taught herein.

Although specific embodiments and certain structural arrangements have been illustrated and described herein, it will be clear to those skilled in the art that various other modifications and embodiments may be made incorporating the spirit and scope of the underlying inventive concepts and that the same are not limited to the particular forms herein shown and described except insofar as determined by the scope of the appended claims.

I claim:

1. Decorative pleats comprising two or more pleats in which a material is folded against itself along an outer fold line and an inner fold line, to form adjacent pleats which fold against each other and wherein said adjacent pleats are connected to each other along or near said inner fold line, wherein two or more of said pleats each have at least two cuts intermediate the ends of said pleats, said cuts extending from said outer fold line toward said inner fold line forming a segment of said pleat between said cuts, wherein said segment is removed from the plane of said pleats by said fold of said pleat included within said segment between the cuts, being reversely folded.

2. The decorative pleats of claim 1 wherein said adjacent pleats are adhered to each other by a width of material extending inwardly, between said pleats, beyond said inner fold line, and wherein said cuts do not sever said width of material.

3. The decorative pleats of claim 1 wherein each said cut extends approximately to the fold line between said pleats and each said cut pleat remains connected to its adjacent pleats, against which it folds, on the opposite side of said fold line from said cut.

4. The decorative pleats of claim 3 wherein said cuts are perpendicular to said fold line.

5. The decorative pleats of claim 3 wherein said cuts are angularly directed with respect to said fold line.

6. The decorative pleats of claim 5 wherein said angular cuts, in each cut pleat, are directed away from each other from said outer fold line to said inner fold line.

7. The decorative pleats of claim 3 wherein said cuts are one or more of angular, curvilinear and zigzag.

8. The decorative pleats of claim 2 wherein said reversed folds comprise an illustration.

9. The decorative pleats of claim 2 wherein said segments comprise a display area and wherein said cut pleats extend over said display area thereby providing means for holding a displayed object in place.

10. The decorative pleats of claim 2 wherein said decorative pleats comprise an illustration and said illustration is comprised of said segments.

11. The decorative pleats of claim 2 wherein said pleats, said cuts in said pleats and said reversed folds in said decorative pleats provide space to insert and hold merchandise in display.

12. The decorative pleats of claim 2 wherein are included top and bottom, rigid elements and wherein said decorative pleats are fixedly attached to said top and bottom, rigid elements, and wherein is further included left and right side rigid elements, said left and right side rigid elements being rigidly connected to said top and bottom rigid elements.

13. The decorative pleats of claim 2 wherein one or more of each said cut is in at least two directions, one of said cut directions being angular to said fold line and another cut direction being perpendicular to said fold line.

14. The decorative pleats of claim 2 wherein is included means for fixedly stiffening said pleats against expanding or contracting.

15. The decorative pleats of claim 14 wherein said means for stiffening comprises frame means and wherein said frame means stiffens said pleats in two directions.

16. The decorative pleats of claim 14 wherein said means for stiffening holds said display in one or more of rectangular, curvilinear, serpentine, helical and spiral shapes.

17. The decorative pleats of claim 14 wherein said pleats are disposed in the shape of a figure of revolution.

18. A decorative display constructed of a plurality of pleats in which a material is folded against itself along a plurality of fold lines to form said pleats, two or more of said fold lines each having at least two cuts therein, without said cuts cutting said pleats into disconnected pleats, and wherein the folds of said pleats are reversely folded between said two cuts.

19. Decorative pleats comprising a plurality of adjacent pleats, each said pleat comprised of material folded along outer and inner fold lines and each said pleat being connected to an adjacent pleat along or near said inner fold line, from said inner fold line for a discrete width beyond said inner fold line, and wherein selected ones of said pleats are each cut at two locations from said outer fold line to approximately said inner fold line, wherein said pleats are not thereby cut into disconnected pleats, and wherein the fold of the segment between said cuts is folded reversely from the fold of its respective pleat.

20. Decorative, accordion pleats comprised of both front and back pleats connected by a width of material between them, said width of material also connecting successive front pleats to each other and successive back pleats to each other, wherein is included two cuts in each of two or more of said pleats, said cuts not being so long as to cut through said front and back pleats, and wherein the fold of the segment of each said cut pleat between said cuts is folded reversely from the fold of said pleat.

* * * * *